US012582861B2

(12) United States Patent
Chironno

(10) Patent No.: US 12,582,861 B2
(45) Date of Patent: Mar. 24, 2026

(54) MULTIFUNCTIONAL HAIR BAND AND EXERCISE DEVICE AND METHOD OF USE

(71) Applicant: Douglas Chironno, New City, NY (US)

(72) Inventor: Douglas Chironno, New City, NY (US)

( * ) Notice: Subject to any disclaimer, the term of this patent is extended or adjusted under 35 U.S.C. 154(b) by 178 days.

(21) Appl. No.: 18/662,029

(22) Filed: May 13, 2024

(65) Prior Publication Data

US 2024/0390723 A1 Nov. 28, 2024

Related U.S. Application Data

(60) Provisional application No. 63/577,794, filed on May 23, 2023.

(51) Int. Cl.

| | |
|---|---|
| ***A63B 21/055*** | (2006.01) |
| ***A41D 20/00*** | (2006.01) |
| ***A41D 31/18*** | (2019.01) |

(52) U.S. Cl.

CPC ..... *A63B 21/0555* (2013.01); *A41D 20/00* (2013.01); *A41D 31/185* (2019.02); *A41D 2300/50* (2013.01)

(58) Field of Classification Search

CPC ..... A63B 21/0555; A63B 2225/09; A63B 21/4037; A41D 20/00; A41D 31/185; A41D 2300/50

See application file for complete search history.

(56) References Cited

U.S. PATENT DOCUMENTS

| | | | | | |
|---|---|---|---|---|---|
| 2,343,408 | A * | 3/1944 | Glass | D06M 17/02 | 428/129 |
| 4,833,734 | A * | 5/1989 | Der Estephanian | A41D 20/00 | 2/22 |
| 5,806,535 | A * | 9/1998 | Becker | A41G 5/0093 | 132/54 |
| 5,823,012 | A * | 10/1998 | Hacskaylo | D04B 1/24 | 66/171 |

(Continued)

FOREIGN PATENT DOCUMENTS

| | | | | |
|---|---|---|---|---|
| CN | 105344063 | A * | 2/2016 | A63B 21/0004 |
| JP | H10504744 | A * | 5/1998 | A45D 8/34 |
| WO | WO-2018134478 | A1 * | 7/2018 | A63B 23/12 |

*Primary Examiner* — Andrew M Kobylarz

(74) *Attorney, Agent, or Firm* — Nolan Heimann LLP; Adam Diament

(57) ABSTRACT

A multifunctional exercise and hair band device is disclosed. The exercise and hair band device includes a folded first layer, and a second layer placed alongside the first layer. The second layer connects to open side ends of the folded first layer, allowing the second layer to protrude outwardly from the first layer. The second layer is pulled through the first layer in an inside-out manner, resulting in the second layer residing within the first layer. The first and second layers' respective distal ends connect, forming a stretchable and durable exercise and hair band device. The exercise and hair band device utilizes soft stretchable fabric layers with a unique stitching technique and exhibits resilience against breakage. The exercise and hair band device offers versatility for use as head band, hair tie, resistance band, hand (Continued)

wrap, and headphone holder, and enhances convenience during workouts by eliminating the need for multiple accessories.

20 Claims, 8 Drawing Sheets

(56) References Cited

U.S. PATENT DOCUMENTS

| | | | | |
|---|---|---|---|---|
| 6,227,011 | B1 * | 5/2001 | Cortinovis | A41D 20/00 66/8 |
| 8,012,071 | B2 | 9/2011 | Grisdale | |
| 9,022,908 | B2 | 5/2015 | Crowell et al. | |
| 9,265,983 | B1 | 2/2016 | Bell | |
| 9,642,432 | B2 | 5/2017 | Carey | |
| 10,188,188 | B2 * | 1/2019 | Passarello | A45D 8/36 |
| D859,742 | S * | 9/2019 | Harrel | D28/41 |
| 11,528,979 | B2 * | 12/2022 | Rubin | A45D 8/34 |
| 11,730,247 | B1 * | 8/2023 | Algabbani | A45D 8/34 132/128 |
| 2004/0055614 | A1 * | 3/2004 | Cave | A45D 8/36 132/275 |
| 2010/0242980 | A1 * | 9/2010 | D'Assis | A45D 8/36 132/273 |
| 2019/0351278 | A1 * | 11/2019 | Walker | A63B 21/00061 |
| 2020/0196730 | A1 * | 6/2020 | Abualhaija | A45D 8/36 |
| 2024/0390723 | A1 * | 11/2024 | Chironno | A63B 21/4037 |

* cited by examiner

MULTIFUNCTIONAL HAIR BAND AND EXERCISE DEVICE AND METHOD OF USE

CROSS-REFERENCE TO RELATED APPLICATIONS

This Applicant claims priority to and benefit of U.S. Provisional Patent Application No. 63/577,794, filed May 23, 2023, entitled "MULTIFUNCTIONAL EXERCISE AND HAIR BAND DEVICE AND METHOD OF USE," the contents of which are incorporated by reference in their entirety.

FIELD OF THE DISCLOSURE

The present invention relates to an elastic band, and more specifically, to an exercise and hair band device.

BACKGROUND OF THE INVENTION

In the realm of personal fitness and exercise, participants often require various accessories and equipment to enhance their workout experience, maintain personal comfort, and protect themselves from common physical ailments associated with exercise routines. Among the most commonly used accessories are resistance bands. The resistance bands are lightweight and versatile strength training equipment that can be used for a variety of exercises and rehabilitation purposes. The resistance bands are integral for adding adjustable levels of difficulty to exercises, or even if a single resistance band is used, it can be useful because resistance bands are easy to transport compared to other types of equipment like free weights. The resistance bands come in a variety of designs, lengths, resistance levels, and have specific uses. This wide range caters to different workout needs and targets various muscle groups.

Fitness enthusiasts often encounter various obstacles that can impede their performance and comfort. Examples include hair obstructing vision, forgetting essential accessories like resistance bands, earbuds falling out, the need for hand support, etc. In order to address the above problems, the fitness enthusiasts have to carry multiple separate items, leading to inconvenience, potential forgetfulness, and increased clutter in gym bags or backpacks. Additionally, traditional exercise equipment and accessories often lack the versatility to serve multiple functions, thereby requiring users to purchase and maintain a collection of single-purpose items. This not only adds to the physical burden of carrying these items but also represents a significant financial investment.

Participants in fitness activities often seek solutions that are not only functional but also fashionable and convenient to use. Even if a resistance band is easy to carry compared to other types of equipment, having equipment ready to use, no matter where one is, and without having to use your hands to carry equipment is beneficial over equipment where one always has to think about having to physically carry the equipment with their hands.

Therefore, there exists a significant need for an innovative solution that combines the functionality of a resistance band with a means to easily transport the band. Such a solution should be comfortable to use, suitable for a wide range of physical activities, and designed with a fashionable aesthetic to appeal to users seeking to integrate fitness into their lifestyle seamlessly.

BRIEF SUMMARY OF THE PRESENT INVENTION

This invention is for an elastic multi-functional exercise resistance band or exercise and hair band device that can also be used as a hair tie.

The present invention provides a multifunctional exercise and hair band device. The multifunctional exercise and hair band device includes a folded first layer, and a second layer placed alongside the first layer. Each of the first layer and the second layer includes a first end and a second end. The second layer is connected to the folded first layer at open side ends of the first layer. The second layer is pulled through the first layer in an inside-out fashion, resulting in the second layer residing inside the first layer. The first end and the second end of the first layer and the second layer are connected forming a stretchable exercise and hair band device.

In one aspect of the present invention, each of the first layer and the second layer comes in a rectangular shape. The second layer is sewn onto the folded first layer via a first seam, leaving a gap formed within the first layer while allowing the second layer to protrude out from the first layer. The second layer is pulled through the first layer in an inside-out fashion, concealing the first seam within the first layer.

In another aspect of the present invention, the second layer is sewn to the first layer at distal ends by a second seam. Further, the distal ends of the first layer and the second layer are connected by a third seam to flatten an intersection point of the first layer and the second layer.

The multifunctional exercise and hair band device can be used as a hair band, head band, resistance band, headphone holder, hand wrap, etc.

DETAILED DESCRIPTION OF EMBODIMENTS

Figure 1:
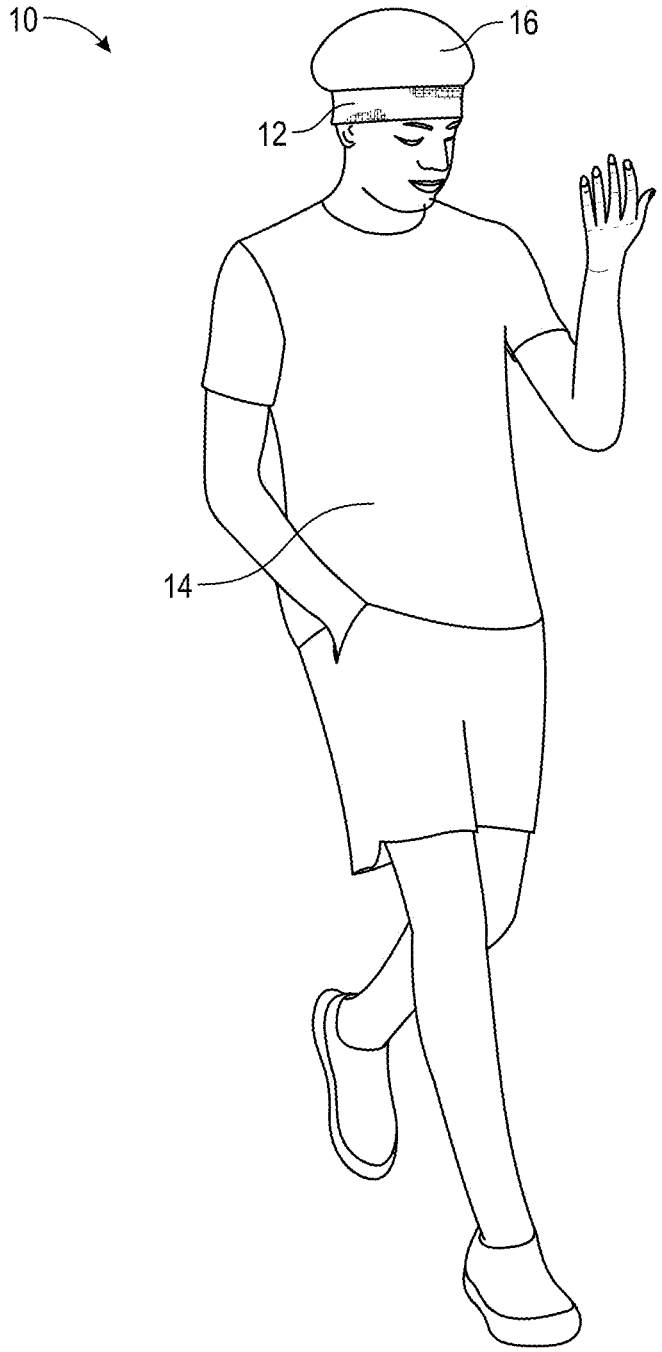
FIG. 1 is an environment in which an exercise and hair band device implements, in accordance with one exemplary embodiment of the present invention.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this Specification are hereby incorporated by reference in their entireties. References cited in an Information Disclosure Statement should not be construed as an admission that the cited reference comes from an area that is analogous or directly applicable to the invention, but rather that the reference is being cited out of an abundance of caution.

Turning to the Figures, FIG. 1 shows an environment 10 in which an exercise and hair band device or elastic exercise resistance band 12 implements, in accordance with one exemplary embodiment of the present invention. In one example, a user 14 wears exercise and hair band device 12 on his head 16 as a head band, as shown in FIG. 1. If needed, user 14 may wear exercise and hair band device 12 for use as a resistance band, a headphone holder, and a hand wrap without deviating from the scope of the present invention.

Figure 2A:
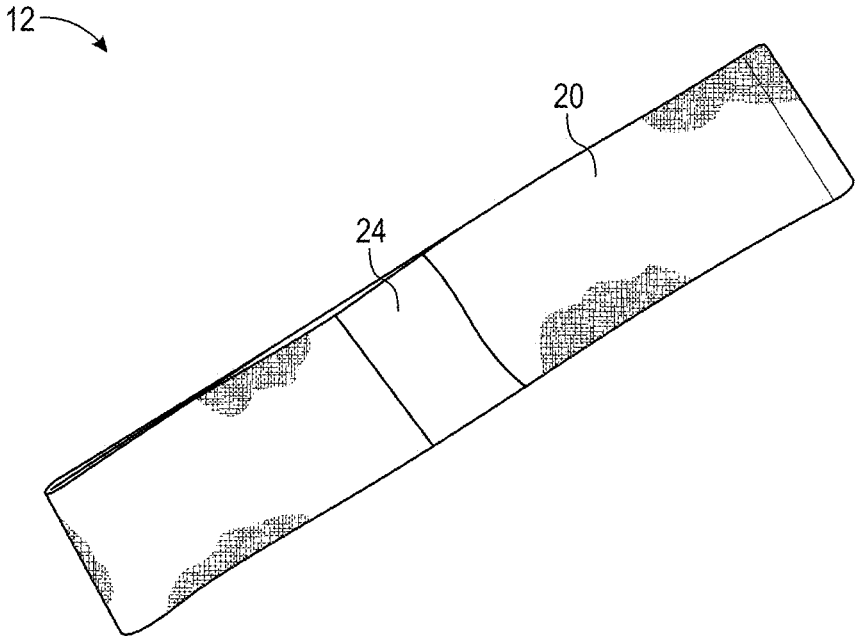
FIG. 2A and FIG. 2B illustrate a front view and a top perspective view, respectively of the exercise and hair band device, in accordance with one embodiment of the present invention.
Figure 2B:
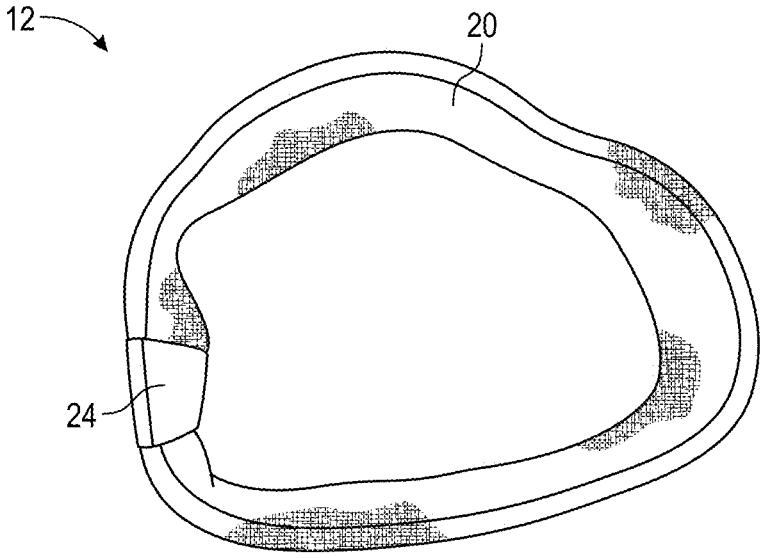

FIG. 2A and FIG. 2B show a front view and a top perspective view, respectively of exercise and hair band device 12, in accordance with one embodiment of the present invention. Exercise and hair band device 12 encompasses a first layer 20 and a second layer 22. Optionally, exercise and hair band device 12 includes an auxiliary fabric 24 for placing a brand name or logo.

Figure 3:
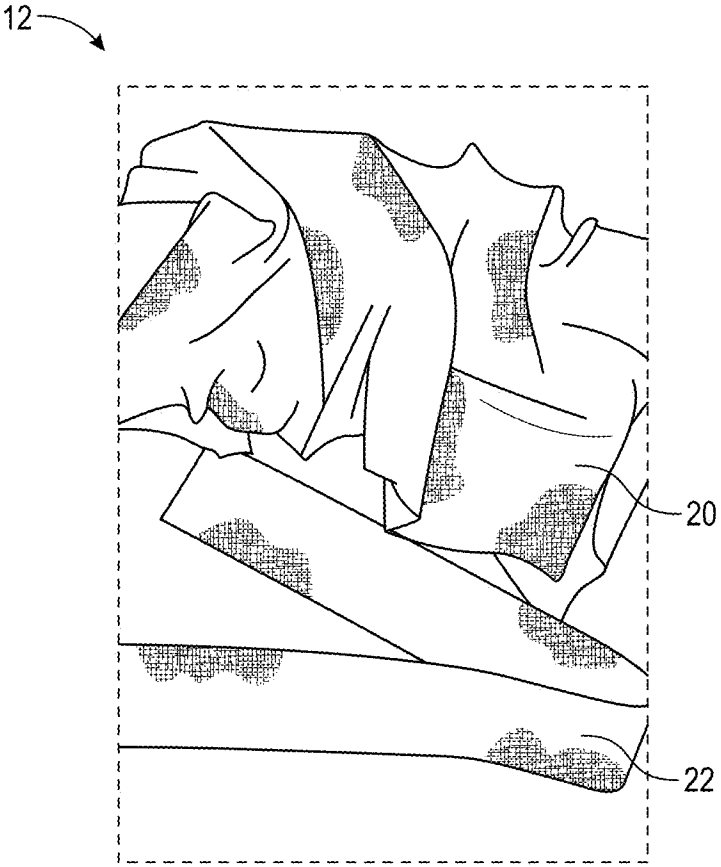
FIG. 3 illustrates a first layer and a second layer laid over a surface.

FIG. 3 shows first layer 20 and second layer 22 laid over a surface (not shown). First layer 20 indicates an outer layer made of a soft, flexible/elastic and breathable material. In one example, first layer 20 includes a Lycra or any other suitable stretchable fabric. Second layer 22 indicates an inner layer made of a soft and flexible material. Second layer 22 indicates an elastic band made up of material having suitable elasticity. In one example, second layer 22 is made of a Spandex material. In one exemplary embodiment, second layer 22 stretches up to 2.5 to 3 times of its original length.

Figure 4:
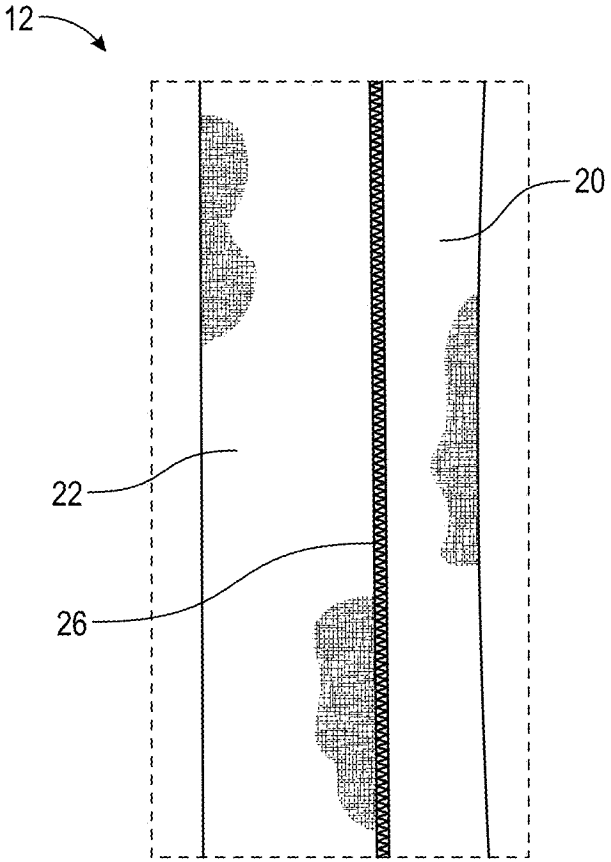
FIG. 4 illustrates the second layer placed alongside of the folded first layer, in accordance with one embodiment of the present invention.

Now referring to FIG. 4 to FIG. 10, the constructional features of exercise and hair band device 12 is explained, in accordance with one embodiment of the present invention. First layer 20 comes in a rectangular configuration. At first, first layer 20 is folded vertically and laid flat on the surface (not shown), such as a floor or a table. Second layer 22 comes in a rectangular configuration. Subsequently, second layer 22 is placed alongside the folded first layer 20, as shown in FIG. 4. It should be understood that second layer 22 comes as a single layer configuration and first layer 20 comes in a two-layered configuration. Second layer 22 has a length similar to folded first layer 20. Second layer 22 is sewn onto folded first layer 20 via a first seam 26. It should be understood that second layer 22 is sewn onto folded first layer 20 at the open ends of first layer 20 leaving a gap formed within first layer 20 while allowing second layer 22 to protrude out from first layer 20.

Figure 6:
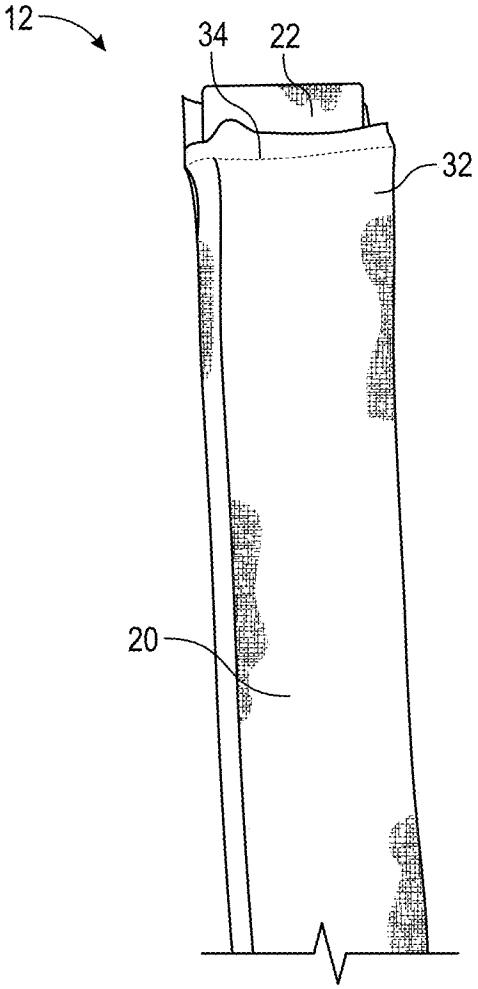
FIG. 6 illustrates the second layer connected to the first layer via a seam, in accordance with one embodiment of the present invention.
Figure 5:
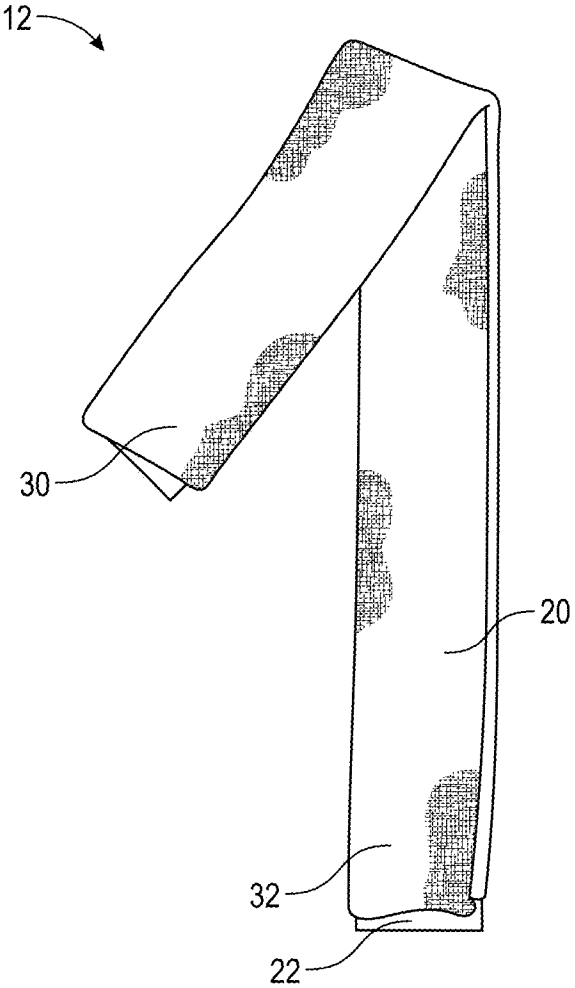
FIG. 5 illustrates the second layer pulled though the first layer, in accordance with one embodiment of the present invention.

After connecting second layer 22 to first layer 20, second layer 22 is pulled through outer first layer 20 in an inside out fashion. FIG. 5 shows the feature of second layer 22 pulled through outer first layer 20. Here, second layer 22 sits inside first layer 20 with a single first seam 26 connecting them at the interior of first layer 20 (one side of second layer 22 is sewn to open ends of first layer 20). This presents a single 4-way stitch/first seam 26 connecting first layer 20 and second layer 22. Since second layer 22 is pulled inside out, first seam 26 gets concealed within first layer 20 and offers a smooth first layer 20 at the outer side. Second layer 22 and first layer 20 present a first end 30 and a second end 32 at respective distal ends. At each of first end 30 and second end 32, first layer 20 and second layer 22 are connected/sewn together by a second seam 34. FIG. 6 shows the feature of first layer 20 connecting second layer 22 via second seam 34 at second end 32, for example.

Figure 9:
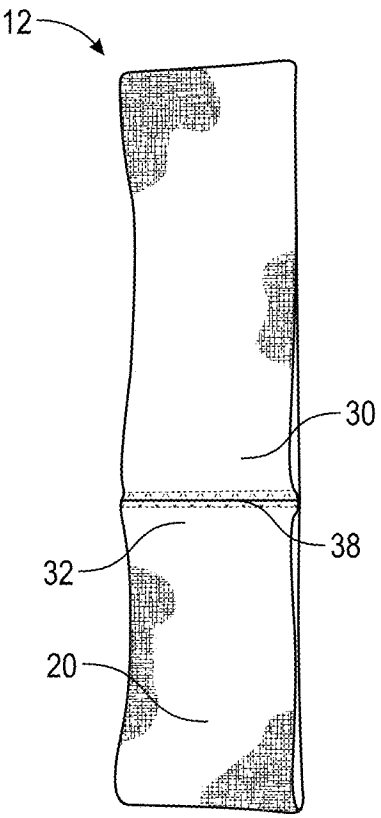
FIG. 9 illustrates an outer view of the first layer having the third seam, in accordance with one embodiment of the present invention.
Figure 8:
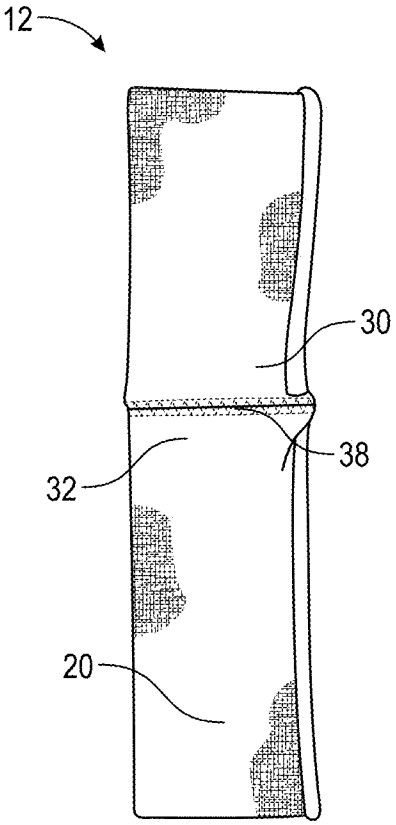
FIG. 8 illustrates an inside view of the first layer having a third seam, in accordance with one embodiment of the present invention.
Figure 7:
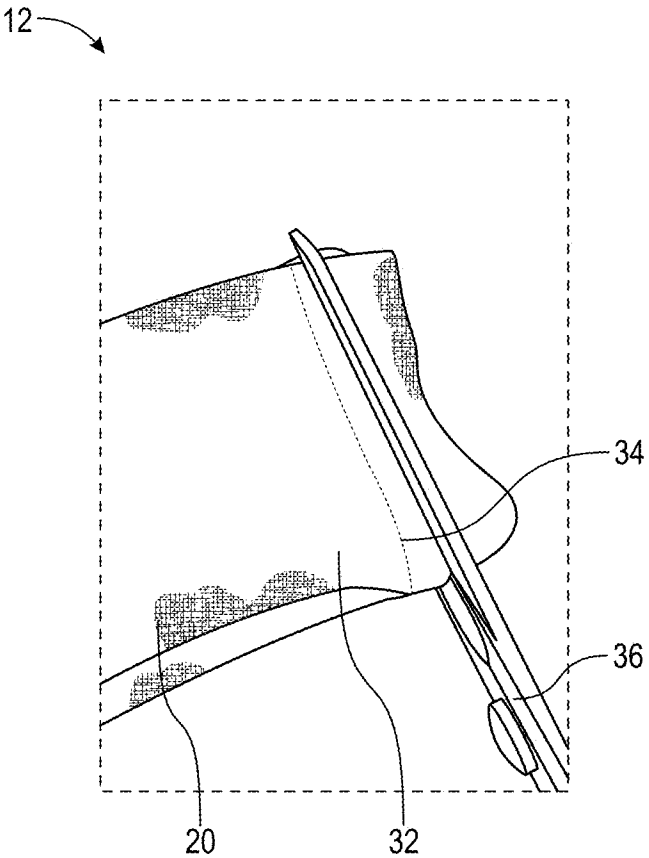
FIG. 7 illustrates the feature of cutting excess first layer and/or second layer, in accordance with one embodiment of the present invention.

Further, a cutting member or scissor 36 is used to cut excess first layer 20 and second layer 22 adjacent to second seam 34 at each first end 30 and second end 32, as shown in FIG. 7. After cutting, first layer 20 and second layer 22 offer straight edges/faces. Subsequently, first end 30 and second end 32 of first layer 20 and second layer 22 are made to face each other. Here, a third seam 38 is used to connect first end 30 and second end 32 of first layer 20 and second layer 22, as can be seen from FIG. 8, for example. In one example, third seam 38 presents a zigzag stitch allowing first layer 20 and second layer 22 to have a flat surface at their intersecting/connecting point. FIG. 8 shows an inside view of first layer 20 having third seam 38. FIG. 9 shows an outer view of first layer 20 having third seam 38, in accordance with one exemplary embodiment of the present invention.

Figure 10:
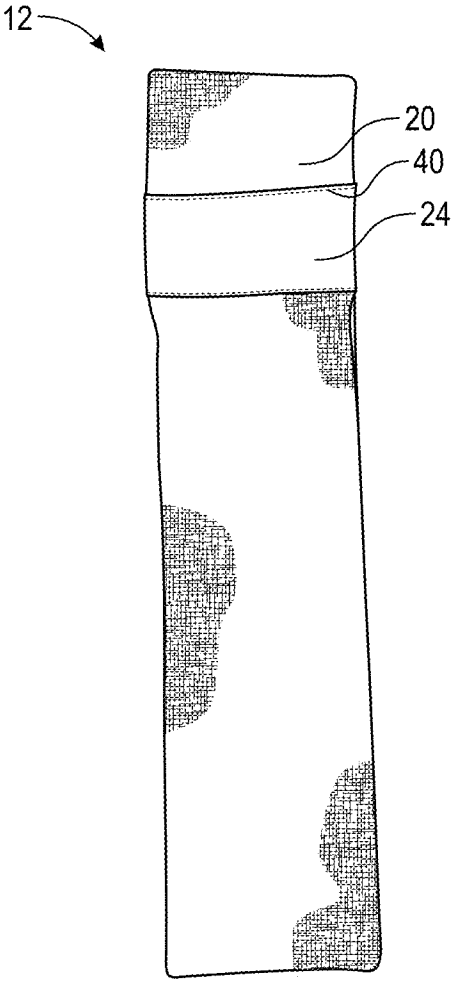
FIG. 10 illustrates an auxiliary fabric wrapped around the exercise and hair band device, in accordance with one embodiment of the present invention.

If needed, auxiliary fabric 24 is wrapped around exercise and hair band device 12 concealing third seam 38. A fourth seam 40 is sewn to connect auxiliary fabric 24 to exercise and hair band device 12, as shown in FIG. 10. Auxiliary fabric 24 indicates a fabric made up of a suitable material. In one exemplary embodiment, auxiliary fabric 24 removably wraps around exercise and hair band device and is sewn on 12. In another exemplary embodiment, auxiliary fabric 24 wraps around using adhesive strips. Auxiliary fabric 24 is used for showcasing the brand name or logo over exercise and hair band device 12. A person skilled in the art understands that exercise and hair band device 12 can be provided without the need for auxiliary fabric 24. Optionally, embodiment, auxiliary fabric 24 can be provided at the outer side of first layer 20.

Figure 11:
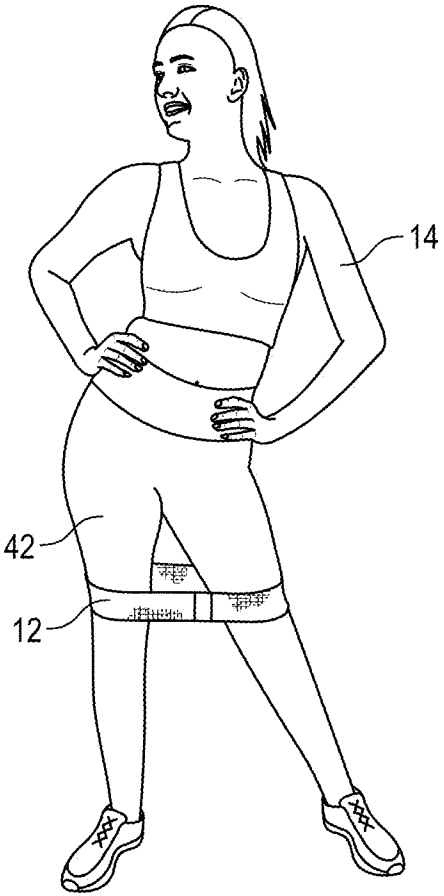
FIG. 11 illustrates a user using the exercise and hair band device as a resistance band around legs, in accordance with one exemplary embodiment of the present invention.
Figure 13:
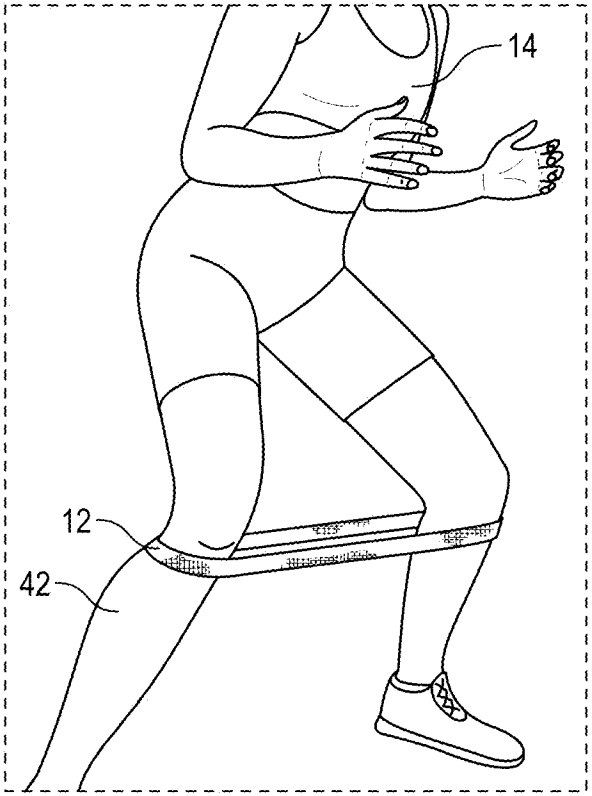
FIG. 13 illustrates the user using the exercise and hair band device as a resistance band around legs for leg exercises, in accordance with one exemplary embodiment of the present invention.
Figure 12:
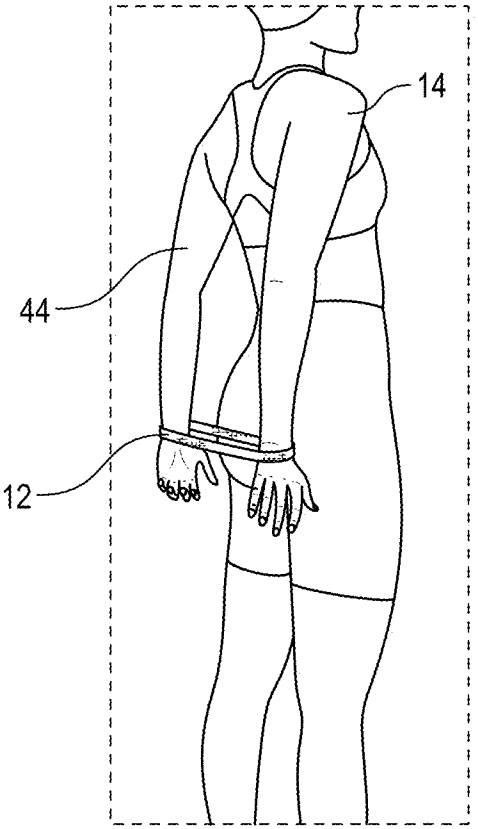
FIG. 12 illustrates the user using the exercise and hair band device as a resistance band around hands, in accordance with one exemplary embodiment of the present invention.
Figure 15:
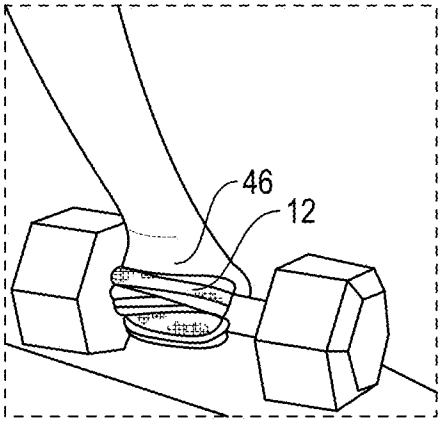
FIG. 15 illustrates the user using the exercise and hair band device as a wrist accessory around wrist for protecting hands from calluses and direct contact with weights, in accordance with one exemplary embodiment of the present invention.
Figure 16:
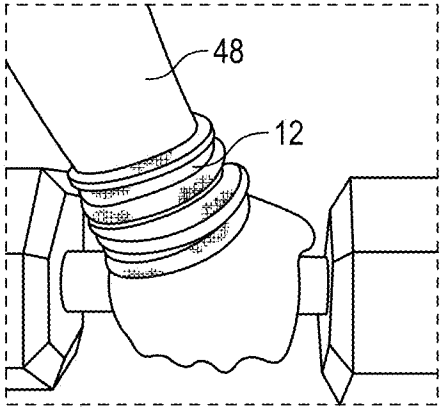
FIG. 16 illustrates the user using the exercise and hair band device as a wrist accessory, in accordance with one exemplary embodiment of the present invention.
Figure 14:
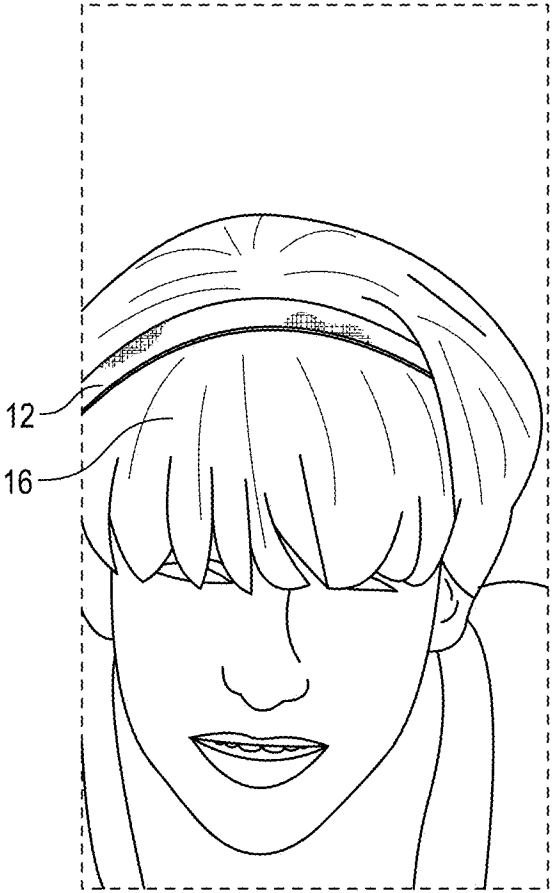
FIG. 14 illustrates the user using the exercise and hair band device as a hair tie around head, in accordance with one exemplary embodiment of the present invention.

As presented above, both first layer 20 and second layer 22 have elasticity properties. As such, exercise and hair band device 12 is stretchable and can be worn in a variety of ways such as a hair band, head band, resistance band, headphone holder, hand wrap, etc. FIG. 11 through FIG. 16 show a variety of ways in which exercise and hair band device 12 can be used by user 14, in accordance with exemplary embodiments of the present invention. FIG. 11 depicts user 14 using exercise and hair band device 12 as a resistance band around legs 42, in accordance with one exemplary embodiment of the present invention. Here, exercise and hair band device 12 can stretch up to 1.5 to 2 times in length, or 1.5 to 3 times in length, and can be used for workouts such as strength training, for example. FIG. 12 depicts user 14 using exercise and hair band device 12 as a resistance band around hands 44, in accordance with one exemplary embodiment of the present invention. Here, exercise and hair band device 12 can be used for shoulder exercises, for example. FIG. 13 depicts user 14 using exercise and hair band device 12 as a resistance band around legs 42, in accordance with one exemplary embodiment of the present invention. Here, exercise and hair band device 12 can be used for leg exercises, for example. FIG. 14 depicts user 14 using exercise and hair band device 12 as a hair tie around head 16, in accordance with one exemplary embodiment of the present invention. Here, user 14 wears exercise and hair band device 12 around head 16 as a hair tie to stop hair and sweat from getting in eyes. FIG. 15 depicts user 14 using exercise and hair band device 12 as a wrist accessory around wrist 46 for protecting hands from calluses and direct contact with weights, in accordance with one exemplary embodiment of the present invention. FIG. 16 depicts user 14 using exercise and hair band device 12 as a wrist accessory, in accordance with one exemplary embodiment of the present invention. Here, user 14 wears exercise and hair band device 12 over hand 48 i.e., above his wrist 46 as a wrist accessory.

Additionally, exercise and hair band device 12 can be worn around ears (not shown) as a headphone holder for holding earphones in place when running/exercising.

The inventor intends to market the presently disclosed exercise and hair band device as Haut-Tie.

The embodiments provide for several advantages over the prior art. For example, the exercise and hair band device offers a unique and innovative multi-purpose product that provides several key advantages over existing headbands, hair ties, resistance bands, and headphone holders in the prior art. The exercise and hair band utilizes soft and stretchable fabrics with a unique stitching technique, rendering it highly durable and resilient against breakage. The exercise and hair band seamlessly integrates various functionalities and eliminates the need for multiple accessories. The users benefit from its versatility as a headband, hair tie, hand wraps, headphone holder, and resistance band, enhancing convenience and efficiency during workouts.

Clause 1. A multifunctional exercise and hair band device, comprising: a first layer, wherein the first layer is folded; and a second layer placed alongside the first layer, wherein each of the first layer and the second layer comprises a first end and a second end, wherein the second layer is connected to the first layer at open side ends of the first layer, wherein the second layer is pulled through the first layer in an inside-out fashion, resulting in the second layer residing inside the first layer, and wherein the first end and the second end of the first layer and the second layer are connected forming the multifunctional exercise and hair band device.

Clause 2. The multifunctional exercise and hair band device of Clause 1, wherein the first layer comes in a rectangular shape when folded, and wherein the second layer comes in a rectangular shape.

Clause 3. The multifunctional exercise and hair band device of Clause 2, wherein the second layer is sewn onto the folded first layer via a first seam, leaving a gap formed within the first layer while allowing the second layer to protrude out from the first layer.

Clause 4. The multifunctional exercise and hair band device of Clause 3, wherein the second layer is pulled through the first layer in an inside-out fashion, concealing the first seam within the first layer.

Clause 5. The multifunctional exercise and hair band device of Clause 1, wherein the second layer is sewn to the first layer at each of the first end and the second end, respectively by a second seam.

Clause 6. The multifunctional exercise and hair band device of Clause 1, wherein the first end and the second end of the first layer and the second layer are connected by a third seam to flatten an intersection point of the first layer and the second layer.

Clause 7. The multifunctional exercise and hair band device of Clause 6, further comprises an auxiliary fabric wrapped around the multifunctional exercise and hair band device concealing the third seam.

Clause 8. The multifunctional exercise and hair band device of Clause 7, wherein auxiliary fabric connects to the multifunctional exercise and hair band device via a fourth seam.

Clause 9. The multifunctional exercise and hair band device of Clause 1, wherein the first layer is made of soft, elastic and breathable material.

Clause 10. The multifunctional exercise and hair band device of Clause 1, wherein the second layer is made of soft and elastic material.

Clause 11. The multifunctional exercise and hair band device of Clause 10, wherein each of the first layer and the second layer is stretchable up to 1.5 to 3 times in length.

Clause 12. A multifunctional exercise and hair band device, comprising: a first layer, wherein the first layer is folded; and a second layer placed alongside the first layer, wherein each of the first layer and the second layer comprises a first end and a second end, respectively, wherein the second layer is sewn to the first layer via a first seam at open side ends of the first layer, leaving a gap formed within the first layer while allowing the second layer to protrude out from the first layer, wherein the second layer is pulled through the first layer in an inside-out fashion concealing the first seam within the first layer, resulting in the second layer residing inside the first layer, wherein the second layer is sewn to the first layer at each of the first end and the second end by a second seam, and wherein the first end and the second end of the first layer and the second layer are connected by a third seam to flatten an intersection point of the first layer and the second layer forming the multifunctional exercise and hair band device.

Clause 13. The multifunctional exercise and hair band device of Clause 12, wherein the first layer comes in a rectangular shape, and wherein the second layer comes in a rectangular shape Clause 14. The multifunctional exercise and hair band device of Clause 12, further comprises an auxiliary fabric wrapped around the multifunctional exercise and hair band device concealing the third seam.

Clause 15. The multifunctional exercise and hair band device of Clause 14, wherein the auxiliary fabric connects to the multifunctional exercise and hair band device via a fourth seam.

Clause 16. The multifunctional exercise and hair band device of Clause 12, wherein the first layer is made of soft, elastic and breathable material.

Clause 17. The multifunctional exercise and hair band device of Clause 12, wherein the second layer is made of soft and elastic material.

Clause 18. The multifunctional exercise and hair band device of Clause 17, wherein each of the first layer and the second layer is stretchable up to 1.5 to 3 times in length.

Clause 19. A method of providing a multifunctional exercise and hair band device, the method comprising steps of: providing a first layer folded in a rectangular configuration; placing a second layer alongside the first layer; connecting the second layer to the first layer at open side ends of the first layer; pulling the second layer through the first layer in an inside-out fashion; and connecting the first layer and the second layer together at each distal end of the first layer and the second layer for forming the multifunctional exercise and hair band device.

Clause 20. The method of Clause 19, further comprising: connecting the second layer to the first layer using a first seam; sewing the second layer to the first layer at the distal ends of the first layer and the second layer by a second seam; and connecting the distal ends of the first layer and the second layer by a third seam for flattening an intersection point of the first layer and the second layer.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

What is claimed is:

1. A multifunctional exercise and hair band device, comprising:

a first layer, wherein the first layer is folded; and a second layer placed alongside the first layer, wherein each of the first layer and the second layer comprises a first end and a second end, wherein the second layer is connected to the first layer at open side ends of the first layer, wherein the second layer is pulled through the first layer (20) in an inside-out fashion, resulting in the second layer residing inside the first layer, and wherein the first end and the second end of the first layer and the second layer are connected forming the multifunctional exercise and hair band device.

2. The multifunctional exercise and hair band device of claim 1, wherein the first layer forms a rectangular shape when folded, and wherein the second layer forms a rectangular shape.

3. The multifunctional exercise and hair band device of claim 2, wherein the second layer is sewn onto the folded first layer via a first seam, leaving a gap formed within the first layer while allowing the second layer to protrude out from the first layer.

4. The multifunctional exercise and hair band device of claim 3, wherein the second layer is pulled through the first layer in the inside-out fashion, concealing the first seam within the first layer.

5. The multifunctional exercise and hair band device of claim 1, wherein the first end and the second end of the first layer and the second layer are connected by a third seam to flatten an intersection point of the first layer and the second layer.

6. The multifunctional exercise and hair band device of claim 5, further comprises an auxiliary fabric wrapped around the multifunctional exercise and hair band device concealing the third seam.

7. The multifunctional exercise and hair band device of claim 6, wherein the auxiliary fabric connects to the multifunctional exercise and hair band device via a fourth seam.

8. The multifunctional exercise and hair band device of claim 1, wherein the second layer is made of soft and elastic material.

9. The multifunctional exercise and hair band device of claim 8, wherein each of the first layer and the second layer is stretchable up to 1.5 to 3 times in length.

10. The multifunctional exercise and hair band device of claim 1, wherein the second layer is sewn to the first layer at each of the first end and the second end, respectively by a second seam.

11. The multifunctional exercise and hair band device of claim 1, wherein the first layer is made of soft, elastic and breathable material.

12. A multifunctional exercise and hair band device, comprising:

a first layer, wherein the first layer is folded; and a second layer placed alongside the first layer, wherein each of the first layer and the second layer comprises a first end and a second end, respectively, wherein the second layer is sewn to the first layer via a first seam at open side ends of the first layer, leaving a gap formed within the first layer while allowing the second layer to protrude out from the first layer, wherein the second layer is pulled through the first layer in an inside-out fashion concealing the first seam within the first layer, resulting in the second layer residing inside the first layer, wherein the second layer is sewn to the first layer at each of the first end and the second end by a second seam, and wherein the first end and the second end of the first layer and the second layer are connected by a third seam to flatten an intersection point of the first layer and the second layer forming the multifunctional exercise and hair band device.

13. The multifunctional exercise and hair band device of claim 12, further comprises an auxiliary fabric wrapped around the multifunctional exercise and hair band device concealing the third seam.

14. The multifunctional exercise and hair band device of claim 13, wherein the auxiliary fabric connects to the multifunctional exercise and hair band device via a fourth seam.

15. The multifunctional exercise and hair band device of claim 12, wherein the second layer is made of soft and elastic material.

16. The multifunctional exercise and hair band device of claim 15, wherein each of the first layer and the second layer is stretchable up to 1.5 to 3 times in length.

17. The multifunctional exercise and hair band device of claim 12, wherein the first layer forms a rectangular shape, and wherein the second layer forms a rectangular shape.

18. The multifunctional exercise and hair band device of claim 12, wherein the first layer is made of soft, elastic and breathable material.

19. A method of providing a multifunctional exercise and hair band device, the method comprising steps of:

providing a first layer folded in a rectangular configuration;

placing a second layer alongside the first layer;

connecting the second layer to the first layer at open side ends of the first layer;

pulling the second layer through the first layer in an inside-out fashion; and connecting the first layer and the second layer together at each distal end of the first layer and the second layer for forming the multifunctional exercise and hair band device.

20. The method of claim 19, further comprising:

connecting the second layer to the first layer using a first seam;

sewing the second layer to the first layer at the distal ends of the first layer and the second layer by a second seam; and connecting the distal ends of the first layer and the second layer by a third seam for flattening an intersection point of the first layer and the second layer.

* * * * *